United States Patent [19]

Parsons et al.

[11] 4,210,254

[45] Jul. 1, 1980

[54] RAILROAD TANK CAR

[75] Inventors: James D. Parsons, Munster; Paul S. Wike, Hammond, both of Ind.

[73] Assignee: Union Tank Car Company, Lincolnshire, Ill.

[21] Appl. No.: 932,817

[22] Filed: Aug. 10, 1978

[51] Int. Cl.[2] ..... B65D 77/06; B65D 87/32; B65D 51/16

[52] U.S. Cl. ..... 220/22; 220/85 B; 220/327; 220/366; 222/154; 222/386.5

[58] Field of Search ..... 220/22, 20, 86 B, 316, 220/327, 325, 366, 86 R; 222/154, 156, 386.5, 388, 478

[56] References Cited

U.S. PATENT DOCUMENTS

| | | | |
|---|---|---|---|
| 1,384,915 | 7/1921 | Parks | 220/327 |
| 1,620,610 | 3/1927 | Davis | 222/154 |
| 1,827,574 | 10/1931 | Frazier | 220/86 R |
| 2,758,747 | 8/1956 | Stevens | 220/85 B |
| 2,984,392 | 5/1961 | Wadenby | 222/386.5 |
| 3,005,317 | 10/1961 | Bunn | 220/85 B |
| 3,141,008 | 7/1964 | Flick | 220/327 |
| 3,351,235 | 11/1967 | Paton | 222/386.5 |
| 3,458,083 | 7/1969 | Erwin | 220/316 |
| 3,502,240 | 3/1970 | Paton | 220/22 |

FOREIGN PATENT DOCUMENTS

| | | | |
|---|---|---|---|
| 2247901 | 5/1975 | France | 220/85 D |
| 445384 | 2/1968 | Switzerland | 220/85 B |

*Primary Examiner*—George E. Lowrance
*Attorney, Agent, or Firm*—Joel E. Siegel; Charles M. Kaplan

[57] ABSTRACT

A flexible diaphragm can be moved to line opposite surfaces of a tank vehicle so that incompatible fluids alternately can be transported in the vehicle without the need for cleaning it. Both sides of the diaphragm are vented to the atmosphere automatically whenever the vehicle container is filled with fluid. The diaphragm is prevented from entering a manway on the vehicle, and an outage gauge is confined entirely within the manway to prevent damage to the diaphragm.

9 Claims, 9 Drawing Figures

6
1
29
14
7
8
4
4
5
9
10
2

3
4
15
6
8
29
7
28
39
45
6
45
4
22
23
14
29
21
20
25

26
3
41
2
17
30
39
31
21
40
36
26
27

2
20
28
61
60
39
62
25
26
63
22
23
21
31
40
30

RAILROAD TANK CAR

BACKGROUND OF THE INVENTION

This invention relates to the storage of fluids, and more particularly to wheeled vehicles for transporting different liquids in a given container.

When a tank truck or a railroad tank car transporting a particular gas or liquid is to be used to transport a different non-compatible fluid, it is necessary to clean the container of the vehicle. This is usually expensive and inconvenient, and the required specialized cleaning facilities frequently are not available. To solve this problem, it has been proposed that vehicles for transporting fluids be provided with a pair of separate inlets and outlets and a flexible diaphragm that alternately lines opposed sides of the vehicle's container. Movement of the diaphragm to line one side of the container provides a chamber for one fluid, and movement of the diaphragm to the opposite side of the container provides a chamber for a different non-compatible fluid. Thus, the container does not have to be cleaned to enable the vehicle to transport either of such fluids. However, there has not been any significant use of such vehicles having a diaphragm that enables them to alternately carry non-compatible fluids without being cleaned in between. One reason such vehicles have not been used has been the extensive modification of standard vehicles believed necessary to prevent damage to the diaphragm or to the vehicle container or components. For example, it is necessary that liquid transport vehicles have a specified minimum empty space or outage in their upper end. A visible gauge that projects into the vehicle tank has been used to identify the uppermost permissible liquid level in the tank. Such a gauge could not be used in a diaphragm vehicle because it could damage, or be damaged by, the diaphragm.

OBJECTIVES OF THE INVENTION

Accordingly it is an object of this invention to provide improved means for storing or transporting non-compatible fluids.

Another object is to provide a storage container including a diaphragm that defines different chambers for different fluids with means for automatically venting both sides of the diaphragm to the atmosphere whenever either chamber is filled with fluid.

Another object is to protect a flexible diaphragm from damage by the components of a vehicle for transporting liquids.

Another object is to provide an outage sight gauge cannot touch a flexible diaphragm that defines different liquid chambers in a transport vehicle.

Another object is to cross vent a pair of manways and/or a pair of quick fill nozzles of a liquid transporting vehicle or container.

Another object is to support a flexible diaphragm in a man-sized hole in a liquid transporting vehicle.

Another object is to prevent an outage sight gauge from damaging a flexible diaphragm in a liquid transportation vehicle.

Another object is to provide a relatively inexpensive, durable, easily maintained railroad tank car having a flexible diaphragm in its container that does not possess defects found in similar prior art tank cars.

Other objects and advantages will be found in the specifications and claims, and the scope of the invention will be pointed out in the claims.

DESCRIPTION OF THE INVENTION

Figure 1:
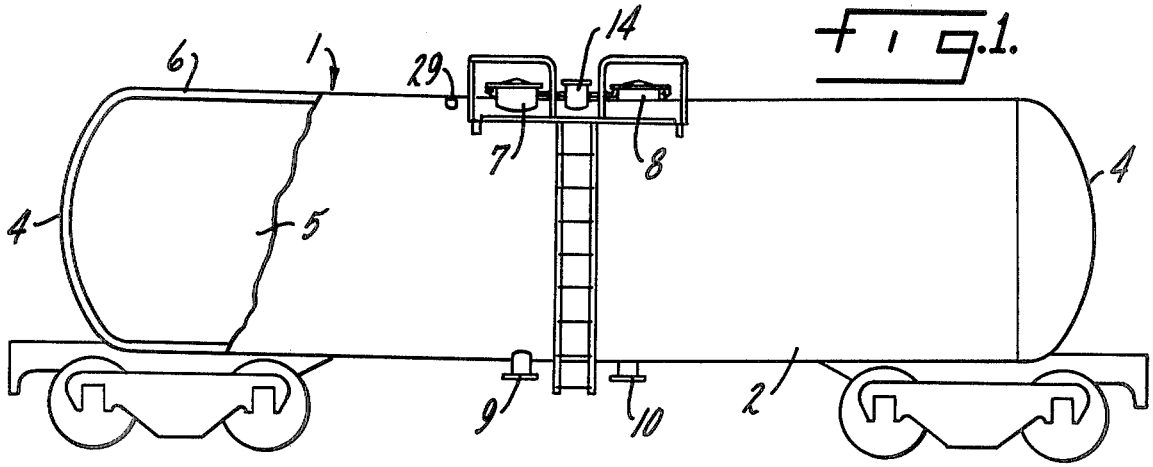
FIG. 1 is a schematic, partially broken-away side view of a railroad tank car in accord with this invention.
Figure 2:
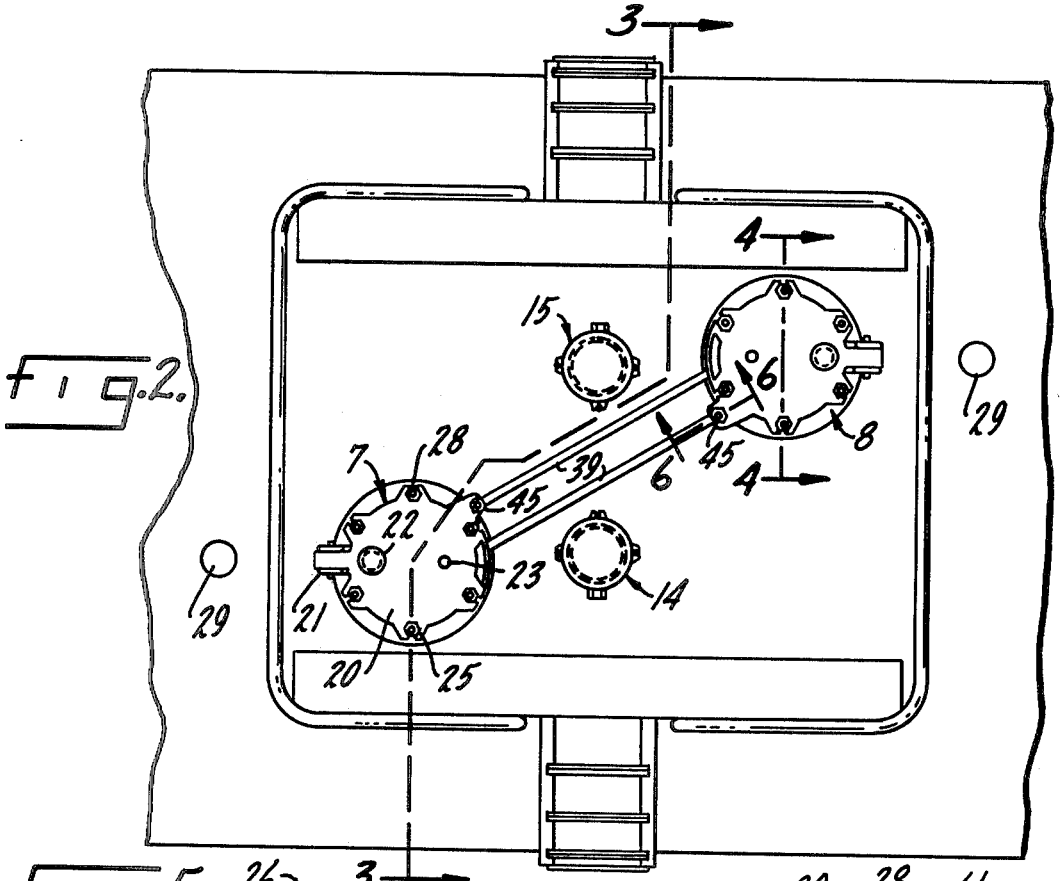
FIG. 2 is an enlarged partial top view of the car shown in FIG. 1.
Figure 5:
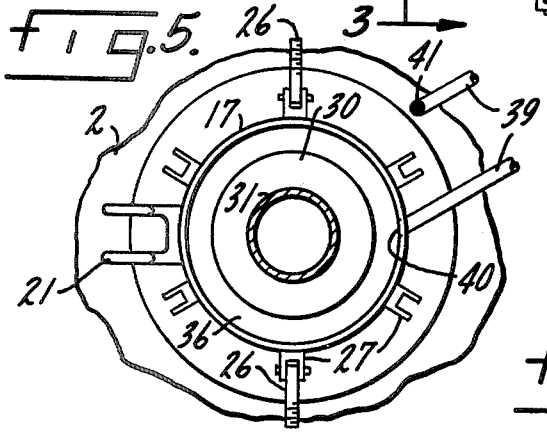
FIG. 5 is a detail view of a manway with parts removed.

The drawing shows a railroad tank car 1 including a metal tank 2 for containing and transporting alternately two different non-compatible liquids, such as lube oil and diesel oil. Container tank 2 is generally cylindrical, and has a generally horizontal longitudinal axis; its ends are closed by dished heads 4. Tank 2 encloses a diaphragm 5 made from a flexible material having its terminal edge clamped at 6 or otherwise sealed against the inside surface of tank 2 around its entire periphery in a generally vertical plane which generally bisects tank 2 longitudinally. A pair of manways 7 and 8 are located adjacent the upper surface of tank 2 on opposite sides of its longitudinal center, and a pair of conventional liquid outlets 9 and 10 are located adjacent the lower surface of tank 2 on opposite sides of its longitudinal center. A pair of quick-fill nozzles 14 and 15 are also located adjacent the upper surface of tank 2 on opposite sides of its longitudinal center. Nozzles 14 and 15 and manways 7 and 8 provide pairs of upwardly extending liquid inlet conduits, each such pair providing an inlet conduit on each side of the plane of the edge of diaphragm 5. Car 1 should be provided with other necessary conventional components and accessories, such as trucks, draft gear, ladders and platforms, which do not form part of the present invention.

Figure 3:
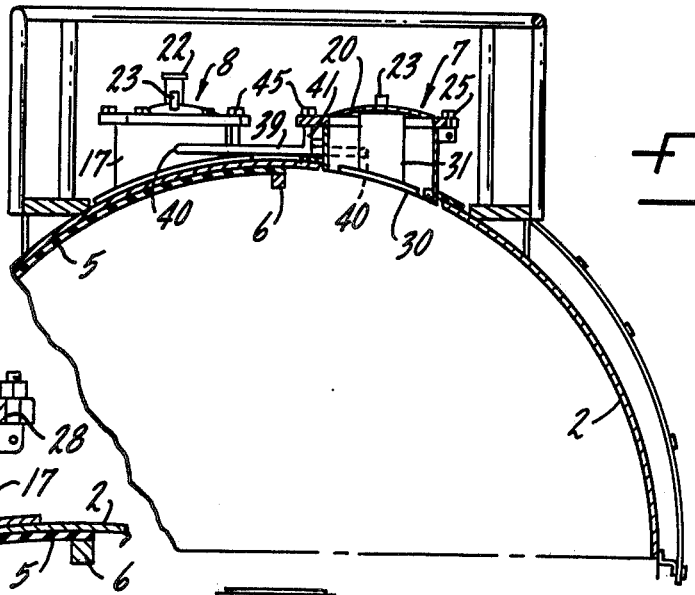
FIG. 3 is a cross sectional view taken along the line 3—3 in FIG. 2.
Figure 4:
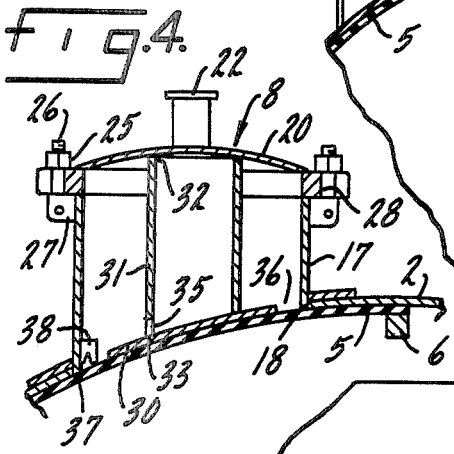
FIG. 4 is a cross sectional view taken along the line 4—4 in FIG. 2.
Figure 8:
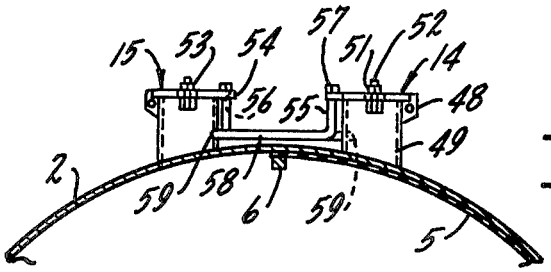
FIG. 8 is a cross sectional view taken along the line 8—8 in FIG. 7.

When tank 2 is filled with a specific liquid through nozzle 14 or manway 7, diaphragm 5 will lie against the inside wall surface of tank 2 and define a chamber for such liquid, as shown in FIG. 3; such liquid would be drained through outlet 9. When tank 2 is filled with a noncompatible liquid through nozzle 15 or manway 8, diaphragm 5 will be against the inside wall surface of tank 2 and define a different chamber for the non-compatible liquid, as shown in FIG. 8; this liquid would be drained through outlet 10. The separate chambers for non-compatible liquids are hermetically isolated, so it is not necessary to clean tank 2 whenever car 1 carries either of such liquids.

Each manway 7 and 8 is made from an upstanding openended cylindrical ring 17 welded to the upper portion of tank 2 around a man-sized hole 18 through the tank. The rings 17 are located outside of and on opposite sides of the plane of the terminal edge of diaphragm 5. A manway cover or lid 20 is pivotally attached to each ring 17 by a hinge 21 for closing the upper open end of the ring. Each lid 20 includes a vacuum relief valve 22 and an air connection 23 of conventional design. Lids 20 may be sealed against the top of rings 17 by nuts 25 threaded on to six bolts 26 attached to hinges 27 on rings 17 and pivotable in conventional manner into slots 28 in lids 20. Conventional pressure relief valves 29 are mounted on tank 2 adjacent the terminal edges of diaphragm 5.

Man-sized hole 18 defines a relatively large area (e.g. two sq. ft.) in which the inside wall of tank 2 cannot support diaphragm 5. Substantial gas or liquid pressures may occur in tank 2 which could force diaphragm 5 through hole 18; this could force diaphragm 5 against components in one of the manways or against the edge of a hole 18 with sufficient force to cut or tear the diaphragm. A baffle plate 30 is shaped to conform to the curvature of the wall of tank 2. When lid 20 is closed, baffle 30 is located in hole 18 so as to define essentially a continuation of the inside surface of the tank wall that provides means for supporting diaphragm 5 and thereby preventing the diaphragm from being forced through hole 18 by pressure in the tank. A cylindrical tubular member 31 extends through ring 17 and has its upper end 32 attached to the underside of lid 20. The lower end 33 of tubular member 31 is attached to the center portion of baffle 30. One or more vent holes 35 are provided in tube 31 at end 33 to permit drainage of liquid or condensation. The annular space 36 separating the edge of baffle 30 from the edge of hole 18 is sufficient to permit lid 20 to swing open without baffle 30 binding against ring 17 but is insufficient to permit diaphragm 30 to enter hole 18.

The vertically lowermost portion or edge 37 of each ring 17 is spaced below the top surface of tank 2 a predetermined vertical distance (e.g. four inches) sufficient to define adequate outage space in the top of the chamber on each side of diaphragm 5 for the liquid in tank 2. An outage sight gauge 38 is located entirely within each ring 17 adjacent edge 37. Gauge 38 may be a brightly colored metal bar or other object that is visible in a manway when in contact with a liquid, and no part of gauge 38 need project below hole 18. Baffle 30 prevents diaphragm 5 from entering hole 18, so the diaphragm cannot contact gauge 38.

When the chamber defined by one side of diaphragm 5 is filled with liquid, it is necessary that the chamber defined by the other side of the diaphragm be vented to the atmosphere. This permits escape of air or vapor from the vented chamber as diaphragm 5 moves against the inside wall surface of tank 2 that had previously defined such vented chamber. Each of manways 7 and 8 has a vent line 39 connecting a vent port 40 on the inside of its ring 17 to a vertical vent pipe 41 to a ring 17. Each lid 20 has a flange 43 that projects outwardly over the adjacent vent pipe 41, and such vent pipe 41 extends upwardly through a hole 44 in a flange 43 when its lid 20 is closed. A removable screw cap 45 engages threads on the upper end of each vent pipe 41 for sealing the vent. Caps 45 are too large to pass through holes 44. Each lid 20 is thereby prevented from being pivoted to its open position until after the cap 45 of its adjacent vent pipe 41 has been removed. Thus, the chambers on both sides of diaphragm 5 are automatically cross vented to the atmosphere whenever either chamber is filled through a manway because neither manway lid 20 can be opened for filling without also removing a cap 45 and thus opening the vent pipe 41 for the other manway.

Figure 7:
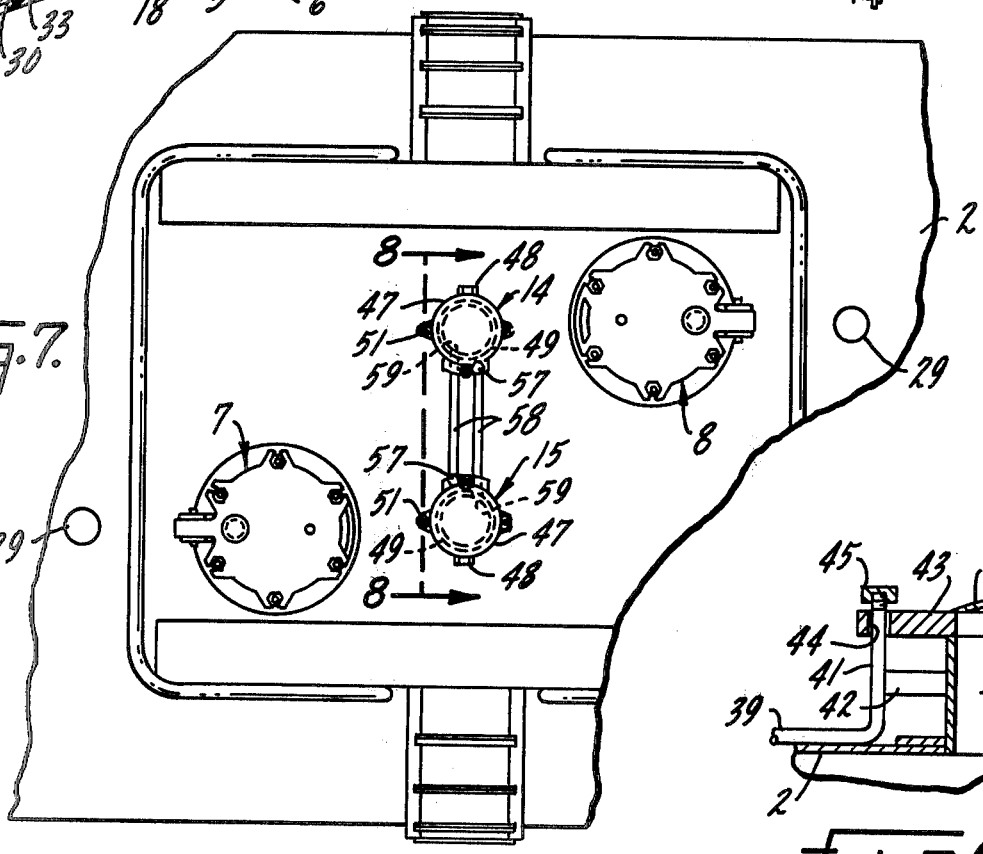
FIG. 7 is a top view corresponding to FIG. 2 showing another embodiment of the invention.
Figure 6:
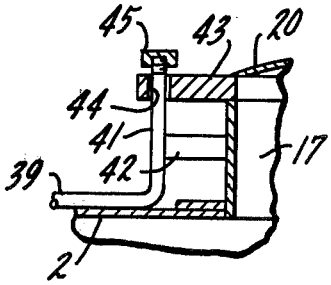
FIG. 6 is a cross sectional view taken along the line 6—6 in FIG. 3.

As shown in FIGS. 7 and 8 the quick-fill nozzles 14 and 15 may also be automatically cross vented in the same manner as manways 7 and 8. Nozzles 14 and 15 are located outside of and on opposite sides of the plane of the terminal edge of diaphragm 5. Each of nozzles 14 and 15 has a lid 47 pivoted on a hinge 48 attached to an upstanding cylindrical filler tube 49 having a relatively small diameter (e.g. 6 inches). Lids 47 are sealed by nuts 51 that thread onto pivotable eye bolts 52 that are received in slots 53 in the same way as described above with reference to manway lids 20. A flange 54 on each lid 47 projects outwardly and captures a vertical vent pipe 55 adjacent each nozzle through a hole 56 in the flange. A removable screw cap 57 threads onto and seals each vent pipe 55 and a vent line 58 connects each vent pipe to a vent port 59 on the inside of the nozzle that communicates with the chamber on the opposite side of diaphragm 5. Caps 57 are too large to pass through holes 56. Each lid is thereby prevented from being pivoted to its open position until after the cap 57 of the adjacent vent pipe 55 has been removed. Thus, the chambers on both sides of diaphragm 5 are automatically cross vented to the atmosphere whenever either chamber is filled through a nozzle 14 or 15 because neither lid 47 can be opened for filling without also removing a cap 57 and thus opening the vent pipe 55 for the other nozzle.

Figure 9:
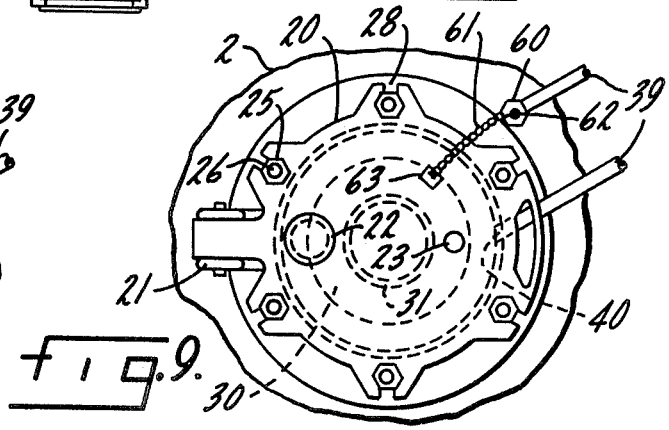
FIG. 9 is a top view of a manway showing another embodiment of the invention.

FIG. 9 shows another embodiment of the invention essentially identical to the previously described embodiments in which the manways 7 and 8 and nozzles 14 and 15 are cross vented, except for the relationship between the cap and the pivotable inlet conduit lid. In FIG. 9 each vent cap 60 is attached to one end of a filament, such as a chain 61, by a swivel 62 that permits rotation of the cap. The other end of each chain 61 is attached to a lug 63 on lid 20, and each chain has a relatively short predetermined length that will not permit lid 20 to be pivoted to its open position until after cap 60 has been removed from the adjacent vent pipe 41. Thus, whenever a manway lid 20 is opened for filling, the other manway is automatically vented because its vent cap 60 has been removed.

In the same manner, the flanges 54 on the lids 47 of nozzles 14 and 15 could be replaced by filaments 61 attached to the lids 47 and to caps 57 by swivels 62. This would automatically cross vent both nozzles whenever either is opened, as described above. It is also possible to cross vent both the manways 7 and 8 and the nozzles 14 and 15, except that the pairs of nozzles and manways should be located such that their respective vent lines 39 and 58 do not cross.

It has thus been shown that by the practice of this invention extensive modification of a railroad tank car 1 is not necessary to permit use of a flexible diaphragm 5 for providing separate chambers for non-compatible fluids. A baffle plate 30 in each of manways 7 and 8 prevents excess pressure or pressure surges from forcing the diaphragm through hole 18, and the location of the lower edge 37 of each manway far enough below the top surface of tank 2 permits the outage sight gauge 38 to be confined entirely within each ring 17 where the diaphragm cannot touch them. The chambers defined on both sides of diaphragm 5 can be automatically cross vented through ports 40 and/or ports 59 by requiring that caps 45 and 57 be removed before lids 20 and lids 47 can be opened.

While the present invention has been described with reference to particular embodiments, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. A container for a plurality of non-compatible liquids, comprising:

A. a generally cylindrical tank having a generally horizontal longitudinal axis;

B. a flexible diaphragm in said tank, the periphery of said diaphragm contacting the wall of said tank in a generally vertical plane which generally bisects said tank, said diaphragm alternately lying against opposite portions of said tank so as to define different chambers for such non-compatible liquids;

C. means for sealing said diaphragm against said wall; and

D. means for filling said chambers with liquid, comprising:

1. a pair of liquid inlet conduits extending upwardly from the upper portion of said tank, said inlet conduits being located on opposite sides of said plane, and each inlet conduit communicating with a chamber inside of said tank on a different side of said diaphragm;

2. a movable lid closing each of said inlet conduits; and 3. means for automatically venting both of said conduits to the atmosphere whenever either of said conduits is opened comprising a vent pipe adjacent each inlet conduit, a line connecting each vent pipe with the inside of the inlet conduit on the opposite side of said diaphragm, a removable cap closing each vent pipe, and means for preventing the movable lid of either inlet conduit from being opened until after the cap of its adjacent vent pipe has been removed.

2. The invention defined in claim 1, wherein said liquid inlet conduits are manway nozzles.

3. The invention defined in claim 1, wherein said liquid inlet conduits are quick-fill nozzles.

4. The invention defined in claim 1, wherein each of said movable lids has a flange with a hole through it, a vent pipe extends through each of said holes when its associated lid is closed, and said caps are larger than said holes, whereby said flanges cannot be moved from around said vent pipes so as to permit opening of said lids unless said caps have been removed.

5. The invention defined in claim 1, wherein each of said caps is connected to a lid by a filament of predetermined length that prevents movement of such lid to its open position unless its associated cap has been removed.

6. The invention defined in claim 1, further comprising an outage sight gauge located entirely within each of said liquid inlet conduits adjacent the lowest portion of said liquid inlet conduits, said gauges being visible from said liquid inlet conduits when in contact with said liquid without ever being contacted by said diaphragm.

7. A wheeled vehicle for transporting a plurality of non-compatible liquids, comprising:

A. a container for such liquids comprising a generally cylindrical tank having a generally horizontal longitudinal axis;

B. a flexible diaphragm in said tank, the periphery of said diaphragm contacting the wall of said tank in a generally vertical plane which generally bisects said tank, said diaphragm alternately lying against opposite portions of said tank so as to define different chambers for such non-compatible liquids;

C. means for sealing said diaphragm against said wall; and

D. means for filling said chambers with liquid, comprising:

1. a pair of liquid inlet conduits extending upwardly from the upper portion of said tank, said inlet conduits being located on opposite sides of said plane, and each inlet conduit communicating with a chamber inside of said tank on a different side of said diaphragm;

2. a movable lid closing each of said inlet conduits, each lid being pivotally attached at one end to its conduit;

3. a vertical vent pipe adjacent each inlet conduit, a vent line connecting each vent pipe to a vent port on the inside of the inlet conduit on the opposite side of said diaphragm; and 4. a removable cap closing each vent pipe, each of said caps being connected to a lid by a filament of predetermined length that prevents pivoting of the lid of either inlet conduit to its open position until after the cap of its adjacent vent pipe has been removed, whereby the chambers on both sides of said diaphragm are vented to the atmosphere whenever either chamber is filled with liquid.

8. A wheeled vehicle for transporting a plurality of non-compatible liquids, comprising:

A. a container for such liquids comprising a generally cylindrical tank having a generally horizontal longitudinal axis;

B. a flexible diaphragm in said tank, the periphery of said diaphragm contacting the wall of said tank, said diaphragm alternately lying against opposite portions of said tank so as to define different chambers for such non-compatible liquids;

C. means for sealing said diaphragm against said wall; and

D. means for filling said chambers with liquid, comprising:

1. a pair of liquid inlet conduits extending upwardly from the upper portion of said tank, said inlet conduits being located on opposite sides of said plane, and each inlet conduit communicating with a chamber inside of said tank on a different side of said diaphragm;

2. a lid closing each of said inlet conduits, each lid being pivotally attached at one end to its conduit and having a flange with a hole through it at its other end;

3. a vertical vent pipe adjacent each inlet conduit, a vent line connecting each vent pipe with a vent port on the inside of the inlet conduit on the opposite side of said diaphragm, each vent pipe extending through the hole in the flange of its associated lid when such lid is closed; and 4. a removable cap closing each vent pipe, said caps being larger than said holes for preventing the lid of either inlet conduit from being opened until after the cap of its adjacent vent pipe has been removed, whereby the chambers on both sides of said diaphragm are vented to the atmosphere whenever either chamber is filled with liquid.

9. The invention defined in claim 8, further comprising a outage sight gauge located entirely within each of said liquid inlet conduits adjacent the lowest portion of said liquid inlet conduits, said gauges being visible from said liquid inlet conduits when in contact with said liquid without ever being contacted by said diaphragm.

* * * * *